US009854926B1

(12) United States Patent
Macchi

(10) Patent No.: US 9,854,926 B1
(45) Date of Patent: Jan. 2, 2018

(54) RECONFIGURING A PICTURE FRAME

(71) Applicant: Dean Macchi, Medway, MA (US)

(72) Inventor: Dean Macchi, Medway, MA (US)

( * ) Notice: Subject to any disclaimer, the term of this patent is extended or adjusted under 35 U.S.C. 154(b) by 0 days.

(21) Appl. No.: 15/260,785

(22) Filed: Sep. 9, 2016

Related U.S. Application Data

(60) Provisional application No. 62/215,848, filed on Sep. 9, 2015.

(51) Int. Cl.
*A47G 1/06* (2006.01)
*B42D 15/00* (2006.01)

(52) U.S. Cl.
CPC ..... *A47G 1/0627* (2013.01); *B42D 15/0093* (2013.01)

(58) Field of Classification Search
CPC ..... A47G 1/06; A47G 1/0627; A47G 1/143; G09F 7/12
See application file for complete search history.

(56) References Cited

U.S. PATENT DOCUMENTS 561,075 A * 5/1896 Furrell ..... A47G 1/06 40/798
2,184,121 A * 12/1939 Henriksen ..... B44C 3/08 156/224
3,836,419 A * 9/1974 Hamberger ..... B44F 7/00 40/124.4
4,393,612 A * 7/1983 Clark ..... A47G 1/0633 40/768
4,741,119 A * 5/1988 Baryla ..... G09F 7/12 40/594
4,967,498 A * 11/1990 Kao ..... A47G 1/143 40/761
4,996,784 A * 3/1991 Hsu ..... A47G 1/0627 40/790
5,025,579 A * 6/1991 Krueger ..... A47G 1/0627 40/769
5,323,551 A * 6/1994 Lovison ..... A47G 1/06 40/745
5,404,663 A * 4/1995 Schober ..... B44C 5/02 40/768
5,783,005 A * 7/1998 Handler ..... A47G 1/0616 156/264
6,289,567 B1 * 9/2001 Robertson ..... A47G 1/0627 29/415

(Continued)

*Primary Examiner* — Cassandra H Davis

(57) ABSTRACT

A framing kit includes a frame body, a plurality of printable sheets, and an alignment tool. Each printable sheet has a pre-cut frame sticker with a size corresponding to the picture frame body such that an item being mounted is viewable through a frame sticker window when the frame sticker is attached to the picture frame body. The frame is customized by printing images, patterns and text on the frame sticker of one of the sheets in a characteristic style suited to the item being mounted and then attaching the frame sticker to the frame body. The alignment tool has a recess with walls and an elevated floor against which the picture frame body and the frame sticker register for alignment when attaching the printed frame sticker to the frame body. New frame stickers may be printed to replace the frame sticker attached to the frame body. For example, a new frame sticker may be created in order to mount a different item in the frame body.

13 Claims, 5 Drawing Sheets

(56) References Cited

U.S. PATENT DOCUMENTS

| | | | | |
|---|---|---|---|---|
| 6,402,878 | B1 * | 6/2002 | Bradford | A47G 1/141<br>156/223 |
| 6,472,038 | B1 * | 10/2002 | Murphy | A47G 1/0627<br>40/702 |
| 6,780,273 | B1 * | 8/2004 | Bradford | A47G 1/141<br>156/108 |
| 8,984,784 | B2 * | 3/2015 | Vallar | A47G 1/06<br>206/216 |
| 2002/0133996 | A1 * | 9/2002 | Driscoll | A47G 1/0627<br>40/799 |
| 2010/0018100 | A1 * | 1/2010 | Lerner | A47G 1/0627<br>40/726 |
| 2014/0047746 | A1 * | 2/2014 | Errair | A47G 1/0627<br>40/711 |

* cited by examiner

RECONFIGURING A PICTURE FRAME

CROSS-REFERENCE TO RELATED APPLICATIONS

This application claims priority to U.S. Provisional Patent Application 62/215,848 entitled Design-Your-Own Picture Frame, filed Sep. 9, 2015, which is incorporated by reference.

BACKGROUND

Picture frames have existed for many years and are in widespread use for displaying photographs, prints, paintings, ticket stubs, and a wide variety of other items. Picture frames come in a wide variety of sizes, shapes, styles, and materials. In general, the characteristics of the picture frame are selected based on the characteristics of the item to be framed. For example, a picture frame may be custom-made with a size and style that is specifically selected to accommodate and be aesthetically pleasing with the item to be framed.

SUMMARY

All examples, aspects and features mentioned in this document can be combined in any technically possible way.

In accordance with an aspect an apparatus comprises: a picture frame body; and a printable frame sticker having a size corresponding to the picture frame body such that an item being mounted is viewable through a frame sticker window when the frame sticker is attached to the picture frame body. In some implementations the printable frame sticker comprises a pre-cut portion of a printable sheet of photo paper. In some implementations the printable sheet of photo paper comprises an adhesive backing. In some implementations the printable frame sticker comprises a cling backing. In some implementations the printable frame sticker comprises a magnetic backing. In some implementations the picture frame body comprises an item mounting surface and a surrounding frame sticker mounting surface to which the frame sticker is attached. In some implementations the apparatus further comprises an alignment tool on which the frame sticker is placed in order to align the frame sticker with the picture frame body for attachment thereto. In some implementations the alignment tool comprises a recess with an elevated floor against which the picture frame body and the frame sticker register for alignment. In some implementations the alignment tool comprises a resilient floor on which the frame sticker is placed.

In accordance with an aspect a method comprises: reconfiguring a picture frame comprising a picture frame body, comprising: printing on a printable frame sticker having a size corresponding to the picture frame body such that an item being mounted is viewable through a frame sticker window when the frame sticker is attached to the picture frame body; and attaching the frame sticker to the picture frame body. Some implementations comprise detaching a pre-cut portion of the printable sheet of photo paper. Some implementations comprise attaching the frame sticker to the picture frame body with an adhesive backing. Some implementations comprise attaching the frame sticker to the picture frame body with a cling backing. Some implementations comprise attaching the frame sticker to the picture frame body with a magnetic backing. Some implementations comprise attaching the frame sticker to a frame sticker mounting surface that surrounds an item mounting surface of the picture frame body. Some implementations comprise placing the frame sticker on an alignment tool in order to align the frame sticker with the picture frame body for attachment thereto. Some implementations comprise, wherein the alignment tool comprises a recess with an elevated floor, registering the picture frame body and the frame sticker against the elevated floor for alignment. Some implementations comprise, wherein the alignment tool comprises a resilient floor on which the frame sticker is placed, pressing the picture frame body against the resilient floor with the frame sticker positioned there between.

In accordance with an aspect a framing kit comprises: a picture frame body; and a plurality of printable sheets, each sheet comprising a pre-cut frame sticker having a size corresponding to the picture frame body such that an item being mounted is viewable through a frame sticker window when the frame sticker is attached to the picture frame body. In some implementations the framing kit further comprises an alignment tool comprising a recess with an elevated floor against which the picture frame body and the frame sticker register for alignment, and a resilient floor on which the frame sticker is placed for attachment to the picture frame body.

DETAILED DESCRIPTION

Figure 1:
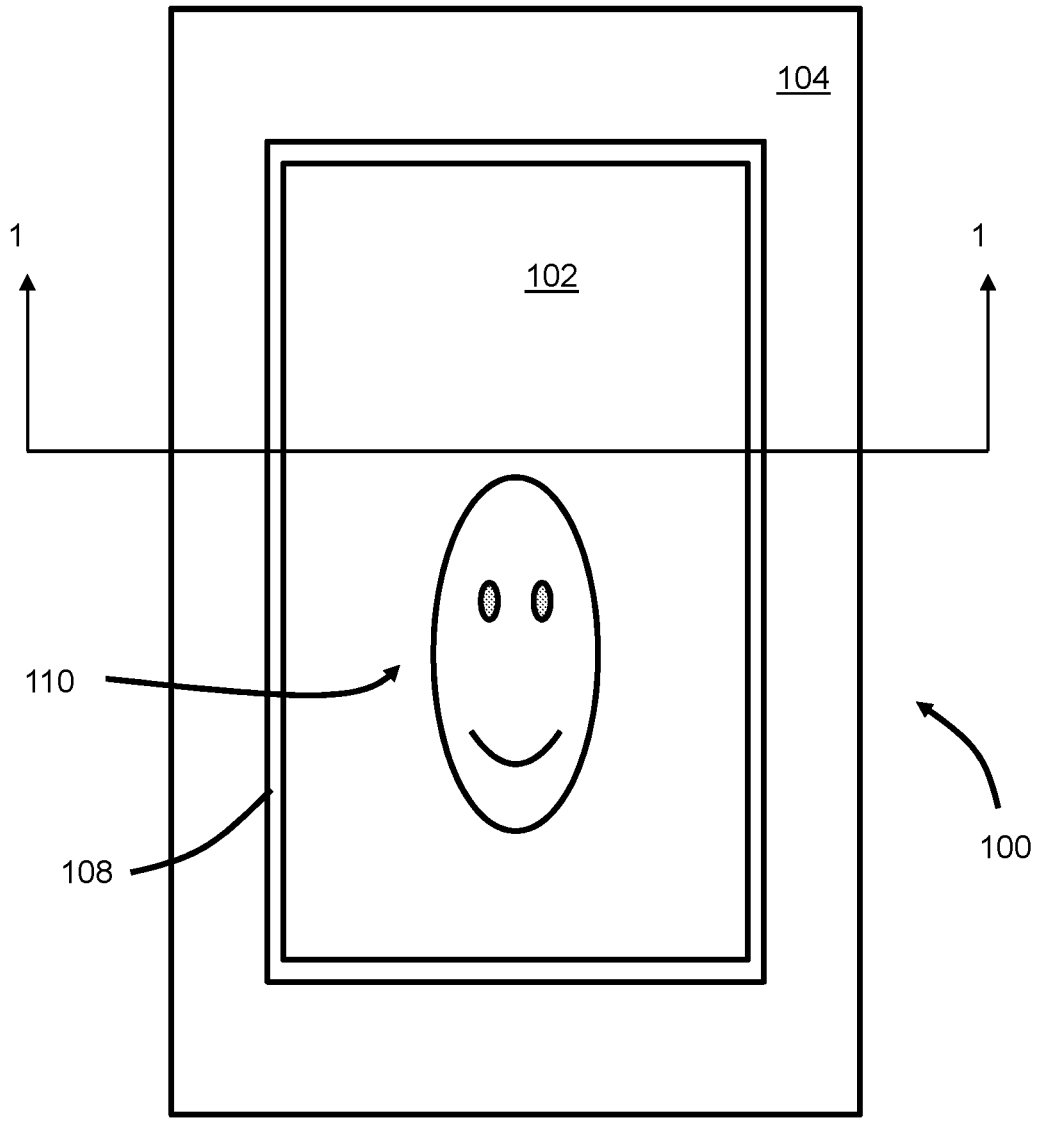
FIG. 1 illustrates an implementation of a picture frame body.

Conventional picture frames are not easily reconfigured. For example, conventional picture frames are usually unsuitable for framing items that differ from the originally framed item in terms of size or appearance. In general, the size and style of a picture frame is selected based on the size and style of the item to be framed. Unless the new item is identical in size to the originally framed item then the size of the picture frame window, i.e. the opening through which the item is viewed, may not be suitable for framing the new item. Moreover, unless the style of the new item is suited to the style of the picture frame that was selected for use with the originally framed item there may be a style mismatch or aesthetically displeasing color clash between the picture frame and the new item. It would therefore be desirable to have a picture frame for which one or more of the style and frame window size could be changed.

In some implementations the presently disclosed inventive concepts include a kit of items that enable a user to reconfigure a picture frame. For example and without limitation, one or more of the frame window size and style of the picture frame may be customized or changed with a user-provided computer and printer. In some implementations the picture frame includes a plurality of printable sheets with pre-cut frame stickers and a frame body to which the frame stickers are applied. Each frame sticker can be printed with unique stylistic characteristics such as colors, images, graphics, text, or combinations thereof. The frame body may include a transparent planar mounting surface through which the mounted item is viewed. The frame stickers may have a circumferential size (shape and dimensions) that matches or corresponds to the circumferential size of the picture frame body. A frame window (interior cutaway portion) of each frame sticker may have a size (shape and dimensions) that corresponds to or matches the size of the item being framed. Adjustments (if any) may be made for mounting placement, and the edges of the frame window may overlap or coincide with the edges of the framed item depending on the implementation. The frame sticker is mounted on the picture frame body after being customized with a style using the computer and printer. In order to reconfigure the picture frame, the existing frame sticker may be replaced with a new frame sticker that differs from the existing frame sticker in terms of size, style, or both. For example, the existing frame sticker can be removed from the mounting surface or the new frame sticker may be adhered directly to the existing frame sticker. The existing and the new frame sticker may be printed with different characteristic colors, images, graphics, text, or combinations thereof. Moreover, the frame sticker window of the new frame sticker may be cut in a size that differs from that of the original frame sticker. Thus, the picture frame can be reconfigured with a different frame window size, style or both, by attaching a user-designed frame sticker to the picture frame body.

Figure 2:
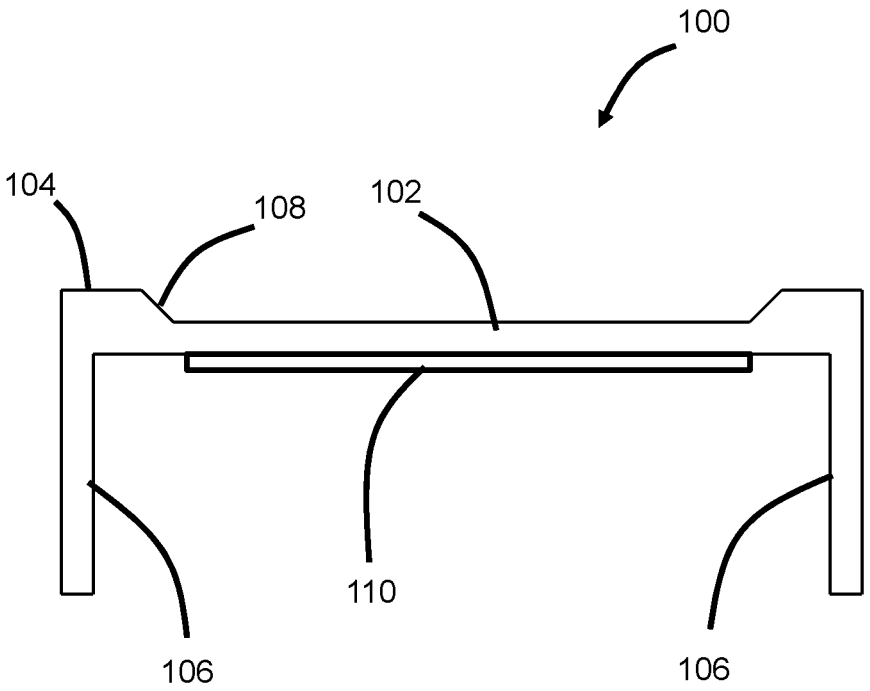
FIG. 2 is a cross-sectional view of the picture frame body of FIG. 1.

FIGS. 1 and 2 illustrate an implementation of a picture frame body 100. The picture frame body 100 includes a planar item mounting surface 102, a frame sticker mounting surface 104, and sidewalls 106. All or part of the picture frame body 100 may be molded or otherwise made from a transparent material such as glass, acrylic or polycarbonate, for example and without limitation. In some implementations the item mounting surface 102 is distinct from the surrounding frame sticker mounting surface 104 on which the frame sticker will be mounted, e.g. a different material, color, height/depth (e.g. in a parallel plane), or combinations thereof. A transition 108 that connects the item mounting surface 102 with the frame sticker mounting surface 104 may be vertical, concave rounded, convex rounded, beveled, or of any of a wide variety of complex or simple molded profiles.

An item 110 to be framed, for example and without limitation a photograph, is mounted against the transparent item mounting surface 102. For example, the item 110 to be framed may be mounted against the underside of the item mounting surface 102, inside the picture frame body 100, so that the mounted item is protected when on display. Those of ordinary skill in the art understand that there are a wide variety of techniques for mounting an item to be displayed against a planar surface through which the item may be viewed when mounted. Such techniques will therefore not be described in further detail.

Figure 3:
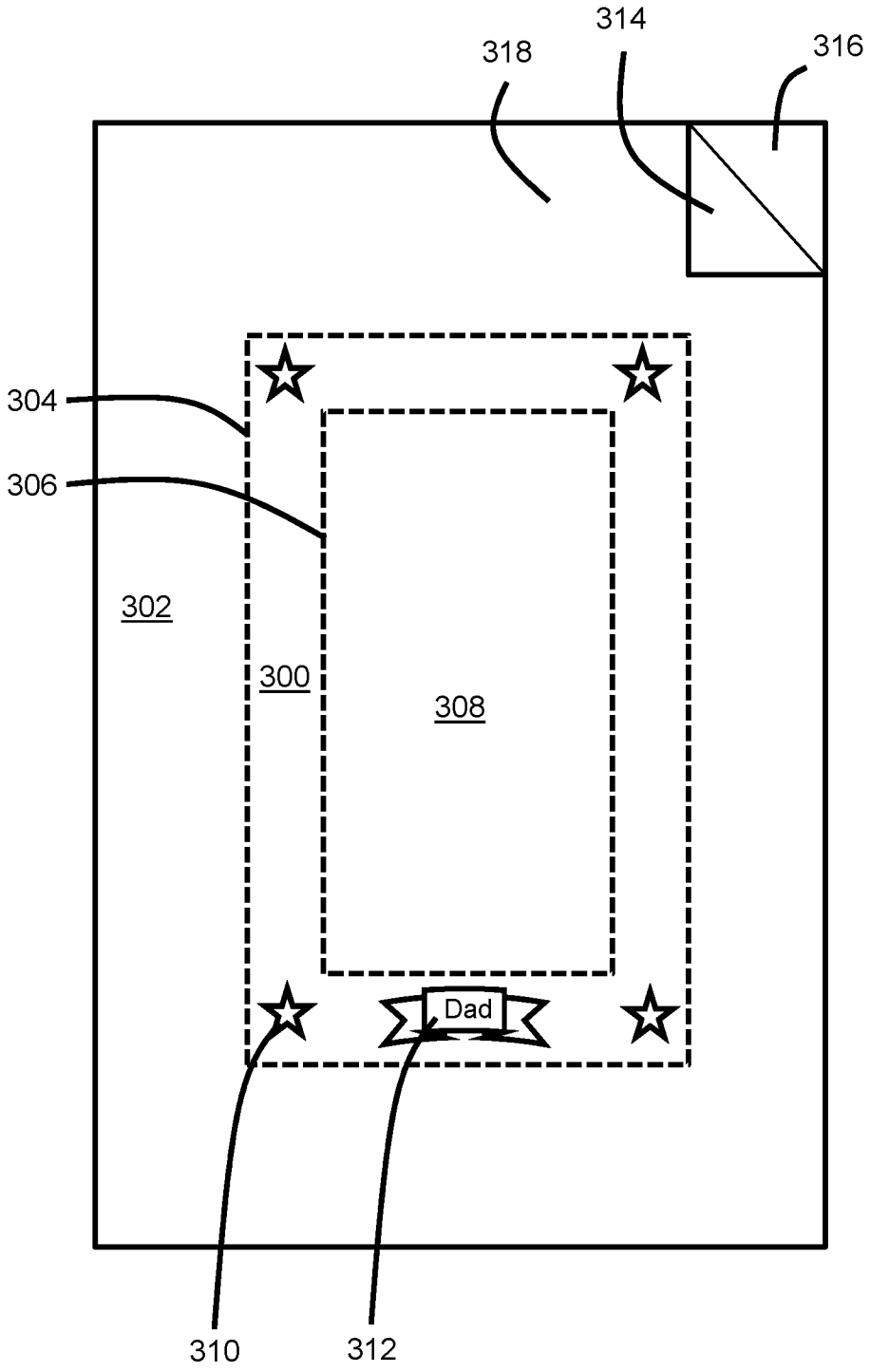
FIG. 3 illustrates a frame sticker for reconfiguring the picture frame.

FIG. 3 illustrates a single printable sheet 302 with a frame sticker 300. Frame stickers may be provided with pre-printed background styles, but the illustrated frame sticker is part of a printable, adhesive backed photo paper sheet 302 that is blank prior to being printed, e.g. transparent, white or uniformly colored. The overall size and weight of the photo paper sheet 302 may be compatible with typical computer printers, for example and without limitation standard 8.5" by 11" or A4 paper size. The photo paper sheet 302 may be pre-cut (e.g. perforated) such that the frame sticker 300 can be easily separated from the sheet. The frame sticker 300 size may differ from the size of the sheet 302. For example, the sheet 302 may be die-cut along a frame sticker outer border 304 and frame sticker inner border 306, thereby providing a frame sticker window 308 sized such that the frame sticker 300 has the same size as the frame sticker mounting surface 104 (FIG. 1) to which it will be adhered. As previously mentioned, a plurality of sheets may be provided as part of a framing kit.

Using a computer and software, e.g. photo printing software, the user may design and print the frame sticker 300 on the photo paper sheet 302 in accordance with the style of the item being framed. For example and without limitation, the software may help the user to align user-selected graphics 310 and user-selected text 312 with the viewable surface of the frame sticker 300 on a printed side 318 of the sheet. In one example an image may be overlaid and printed on the frame sticker 300 to depict a theme corresponding to the item being framed, e.g. an image associated with a particular sport where the item being framed is a ticket or photograph associated with that sport. Once printed, the frame sticker 300 may be separated from the sheet of photo paper along outer border 304 and from the frame sticker window 308 along the inner border 306. An adhesive backing surface 314 may be exposed at any time after printing, either before or after separating the frame sticker along the outer and inner borders 304, 306, by peeling away a backing paper 316. The frame sticker 300 may then be adhered to the picture frame body, e.g., to the frame sticker mounting surface 104 (FIG. 1).

In some implementations the frame sticker 300 does not rely on an adhesive backing for attachment to the picture frame body, and may be created from a material other than printable photo paper. For example and without limitation, the frame sticker could include a thin magnetic backing joined with a printable material. The magnetic backing could be magnetically mounted on a ferrous metal picture frame body. In some implementations the frame sticker is secured to the picture frame body based on suction, mechanical hook and loop fasteners or other attachment technology. For example, the frame sticker 300 could be printed on a pre-cut clear or colored vinyl "static cling" sheet that sticks to smooth surfaces without reliance on adhesives. As will be explained in greater detail below, the frame sticker may be aligned with the picture frame body by hand or with the aid of an alignment tool.

Figure 4:
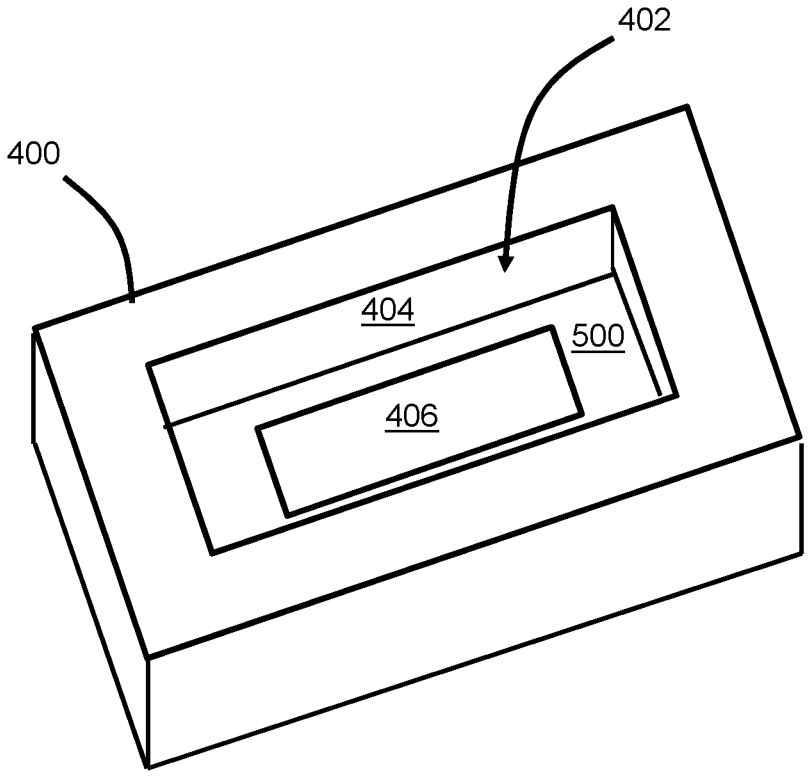
FIG. 4 illustrates a frame sticker alignment tool.
Figure 5:
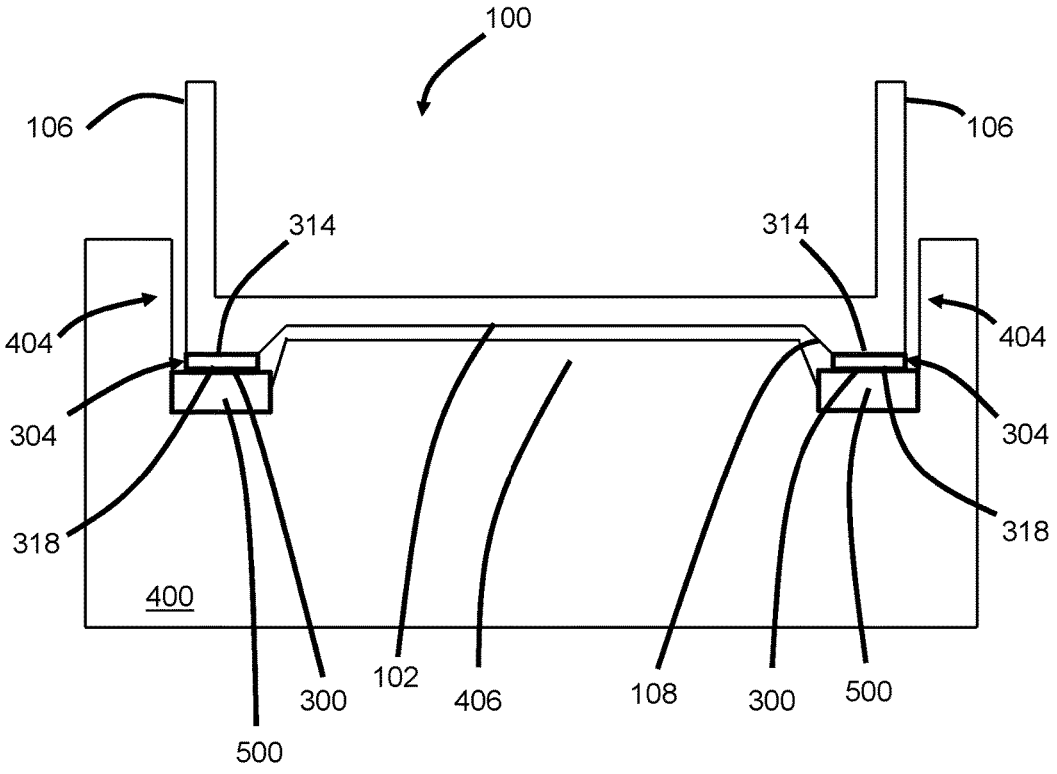
FIG. 5 is a cross-sectional view of the alignment tool with a frame sticker and picture frame body positioned therein.

FIGS. 4 and 5 illustrate an alignment tool 400 for use in aligning the frame sticker 300 with the picture frame body 100 and mounting the frame sticker thereon. The alignment tool 400 may include a block with a recess 402 formed therein. The recess 402 may have a size corresponding to the size of the picture frame body 100 and the frame sticker 300 such that the outer border 304 of the frame sticker and sidewalls 106 of the picture frame body register against alignment tool walls 404 of the recess 402, e.g. with some tolerance to enable easy insertion and withdrawal of the frame sticker and picture frame body from the recess. An elevated floor 406 of the recess 402 may align the picture frame body by registering against the transition 108 and/or glass mounting surface 102. More particularly, either or both the walls 404 and the elevated floor 406 may be used for alignment. A resilient floor member 500 supported by springs or a block of resilient material may provide a surface against which the frame sticker rests.

The printed frame sticker 300 is placed in the recess in order to prepare to install the frame sticker 300 on the picture frame body 100. More particularly, the frame sticker is oriented with the printed design side 318 facing down, against the resilient floor member 500, with the adhesive side 314 facing up. The backing paper may be removed from the frame sticker at this time if it hasn't already been removed. With the alignment tool 400 resting on a flat horizontal surface, the picture frame body 100 is aligned with the walls 404 and elevated floor 406 of the recess and inserted therein. In particular, with both the frame sticker and picture frame body registered in alignment by the walls 404 and the elevated floor 406 the frame sticker mounting surface is pressed against the adhesive side 314 of the frame sticker, thereby attaching the frame sticker to the frame sticker mounting surface in proper alignment. The resilient floor member 500 helps to evenly distribute pressure across the surface area of the frame sticker in order to help adhere the frame sticker to the picture frame without folds or bubbles.

Referring again to FIGS. 2 and 3, in some implementations the frame sticker mounting surface 104 is not distinct from the item mounting surface 102. For example, both the frame sticker mounting surface and the item mounting surface could be a single planar surface or pane, e.g. without an interconnecting transition. In such implementations it may be possible to change the size of the frame sticker window 308, e.g. to accommodate a different sized item 110 being mounted. Printable sheets may be pre-cut with frame sticker windows in any of a wide variety of sizes and provided as part of a kit. For example and without limitation, the frame sticker windows may be pre-cut to sizes corresponding to standard photograph sizes or ticket stub sizes. The user selects a blank sheet having an appropriately sized pre-cut sticker frame window for the item being mounted and prints the frame sticker in a selected style.

A number of features, aspects, embodiments and implementations have been described. Nevertheless, it will be understood that a wide variety of modifications and combinations may be made without departing from the scope of the inventive concepts described herein. Accordingly, those modifications and combinations are within the scope of the following claims.

What is claimed is:

1. An apparatus comprising:

a picture frame body;

a printable frame sticker having a size corresponding to the picture frame body such that an item being mounted is viewable through a frame sticker window when the frame sticker is attached to the picture frame body; and an alignment tool on which the frame sticker is placed in order to align the frame sticker with the picture frame body for attachment thereto, the alignment tool comprising a recess with an elevated floor against which the picture frame body and the frame sticker register for alignment, and a resilient floor on which the frame sticker is placed.

2. The apparatus of claim 1 wherein the printable frame sticker comprises a pre-cut portion of a printable sheet of photo paper.

3. The apparatus of claim 2 wherein the printable sheet of photo paper comprises an adhesive backing.

4. The apparatus of claim 1 wherein the printable frame sticker comprises a cling backing.

5. The apparatus of claim 1 wherein the printable frame sticker comprises a magnetic backing.

6. The apparatus of claim 1 wherein the picture frame body comprises an item mounting surface and a surrounding frame sticker mounting surface to which the frame sticker is attached.

7. A method comprising:

reconfiguring a picture frame comprising a picture frame body, comprising:

printing on a printable frame sticker having a size corresponding to the picture frame body such that an item being mounted is viewable through a frame sticker window when the frame sticker is attached to the picture frame body;

placing the frame sticker on an alignment tool in order to align the frame sticker with the picture frame body for attachment thereto, wherein the alignment tool comprises a recess with an elevated floor, and comprising registering the picture frame body and the frame sticker against the elevated floor for alignment; and attaching the frame sticker to the picture frame body, wherein the alignment tool comprises a resilient floor on which the frame sticker is placed, and comprising pressing the picture frame body against the resilient floor with the frame sticker positioned there between.

8. The method of claim 7 comprising detaching a pre-cut portion of the printable sheet of photo paper.

9. The method of claim 7 comprising attaching the frame sticker to the picture frame body with an adhesive backing.

10. The method of claim 7 comprising attaching the frame sticker to the picture frame body with a cling backing.

11. The method of claim 7 comprising attaching the frame sticker to the picture frame body with a magnetic backing.

12. The method of claim 7 comprising attaching the frame sticker to a frame sticker mounting surface that surrounds an item mounting surface of the picture frame body.

13. A framing kit comprising:

a picture frame body;

a plurality of printable sheets, each sheet comprising a pre-cut frame sticker having a size corresponding to the picture frame body such that an item being mounted is viewable through a frame sticker window when the frame sticker is attached to the picture frame body; and an alignment tool comprising a recess with an elevated floor against which the picture frame body and the frame sticker register for alignment, and a resilient floor on which the frame sticker is placed for attachment to the picture frame body.

* * * * *